US009423762B2

(12) United States Patent
Souda

(10) Patent No.: US 9,423,762 B2
(45) Date of Patent: Aug. 23, 2016

(54) IMAGE FORMING APPARATUS WITH FRAME HAVING HOLLOWLY-FORMED CONNECTING FRAMES

(71) Applicant: Makoto Souda, Nagoya (JP)

(72) Inventor: Makoto Souda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/230,073

(22) Filed: Mar. 31, 2014

(65) Prior Publication Data

US 2014/0376956 A1 Dec. 25, 2014

(30) Foreign Application Priority Data

Jun. 20, 2013 (JP) ..... 2013-129798

(51) Int. Cl.

| | |
|---|---|
| ***G03G 15/00*** | (2006.01) |
| ***G03G 21/16*** | (2006.01) |
| ***G03G 15/01*** | (2006.01) |
| ***G03G 21/18*** | (2006.01) |

(52) U.S. Cl.

CPC ..... *G03G 21/1619* (2013.01); *G03G 15/0178* (2013.01); *G03G 21/1853* (2013.01); *G03G 2215/0141* (2013.01); *G03G 2221/1684* (2013.01)

(58) Field of Classification Search

CPC ..... G03G 21/1619
USPC ..... 399/107
See application file for complete search history.

(56) References Cited

U.S. PATENT DOCUMENTS

| | | | | |
|---|---|---|---|---|
| 7,783,226 | B2 | 8/2010 | Tomatsu | |
| 7,876,476 | B2 | 1/2011 | Tomatsu | |
| 2005/0105953 | A1 | 5/2005 | Katayama et al. | |
| 2005/0220479 | A1 | 10/2005 | Ito et al. | |
| 2005/0220482 | A1 | 10/2005 | Ishii | |
| 2005/0220494 | A1 | 10/2005 | Kato et al. | |
| 2005/0220517 | A1 | 10/2005 | Matsushima et al. | |
| 2005/0221907 | A1 | 10/2005 | Kato et al. | |
| 2007/0146809 | A1 | 6/2007 | Tomatsu | |
| 2007/0160382 | A1* | 7/2007 | Tomatsu | G03G 21/1619 399/107 |
| 2011/0076047 | A1* | 3/2011 | Nobe | G03G 15/5004 399/88 |
| 2011/0102983 | A1 | 5/2011 | Souda et al. | |
| 2011/0129250 | A1* | 6/2011 | Kondo | G03G 21/1619 399/107 |
| 2011/0129276 | A1* | 6/2011 | Kondo | 400/613 |

FOREIGN PATENT DOCUMENTS

| | | | |
|---|---|---|---|
| JP | H08-6336 | A | 1/1996 |
| JP | H10-161507 | A | 6/1998 |
| JP | 2006-044057 | A | 2/2006 |
| JP | 2007-148141 | A | 6/2007 |
| JP | 2007-148142 | A | 6/2007 |
| JP | 2011-095495 | A | 5/2011 |

* cited by examiner

*Primary Examiner* — Quana M Grainger
(74) *Attorney, Agent, or Firm* — Banner & Witcoff, Ltd.

(57) ABSTRACT

An image forming apparatus, including image forming units, a pair of frames, an optical scanner, a metal-made first connecting frame, a resin-made second connecting frame, is provided. The first and second connecting frames are formed to be hollow and are coupled to the paired frames at both ends thereof along an axial direction of rotation axes of photosensitive drums contained in the image forming units. The first connecting frame accommodates the optical scanner in the hollow space.

10 Claims, 7 Drawing Sheets

IMAGE FORMING APPARATUS WITH FRAME HAVING HOLLOWLY-FORMED CONNECTING FRAMES

CROSS REFERENCE TO RELATED APPLICATION

This application claims priority from Japanese Patent Application No. 2013-129798, filed on Jun. 20, 2013, the entire subject matter of which is incorporated herein by reference.

BACKGROUND

1. Technical Field

An aspect of the present invention relates to an image forming apparatus having an optical scanner configured to emit exposure light to a photosensitive drum.

2. Related Art

An image forming apparatus having an optical scanner is known. The image forming apparatus may include a scanner-supporting plate arranged in a lower position with respect to the optical scanner, an upper frame arranged in an upper position with respect to the optical scanner, and side frames arranged on lateral positions of the scanner-supporting plate and the upper plate so that the scanner-supporting plate and the upper plate may be attached to the lateral frames at lateral ends thereof. In such an image forming apparatus, each of the scanner-supporting plate and the upper plate may be assembled independently in a body of the image forming apparatus. In this regard, the scanner-supporting plate, the upper plate, and the lateral frames may form an open cross-section when viewed along a plane orthogonal to a crosswise direction thereof.

SUMMARY

In the image forming apparatus with the above-mentioned frame structure in the body, in which the lateral frames are connected with each other by the lower and upper plates, while the lower and upper plates are assembled in the body independently from each other, substantial rigidity may not be provided.

The present invention is advantageous in that an image forming apparatus, in which rigidity in a frame structure having a pair of mutually connected lateral frames is increased, is provided.

According to an aspect of the present invention, an image forming apparatus is provided. The image forming apparatus includes a plurality of image forming units, each of which comprises a photosensitive drum configured to be rotatable about a rotation axis and a developer device configured to supply a developer agent to the photosensitive drum, the plurality of image forming unit being aligned along an aligning direction, the aligning direction being orthogonal to an axial direction, which is a direction of the rotation axes of the photosensitive drums; a pair of frames arranged to face each other along the axial direction across the plurality of image forming units, the pair of frames being configured to support the plurality of image forming units; an optical scanner arranged on one side of the plurality of image forming units along an orthogonal direction orthogonal to the aligning direction and to the axial direction, the optical scanner being configured to emit exposure light to the plurality of photosensitive drums; a first connecting frame made of a metal and formed to be hollow providing a space inside, the first connecting frame being coupled to the pair of frames at both ends thereof along the axial direction and being configured to accommodate the optical scanner therein; and a second connecting frame made of a metal and arranged on another side of the plurality of image forming units along the orthogonal direction, the second connecting frame being formed to be hollow providing a space inside, the second connecting frame being coupled to the pair of frames at both ends thereof along the axial direction.

BRIEF DESCRIPTION OF THE ACCOMPANYING DRAWINGS

DETAILED DESCRIPTION

Hereinafter, a configuration of a color printer 1 according to an embodiment of the present invention will be described with reference to the accompanying drawings. First, an overall configuration of the color printer 1 will be described, and second, specific components in the color printer 1 will be described in detail.

Figure 1:
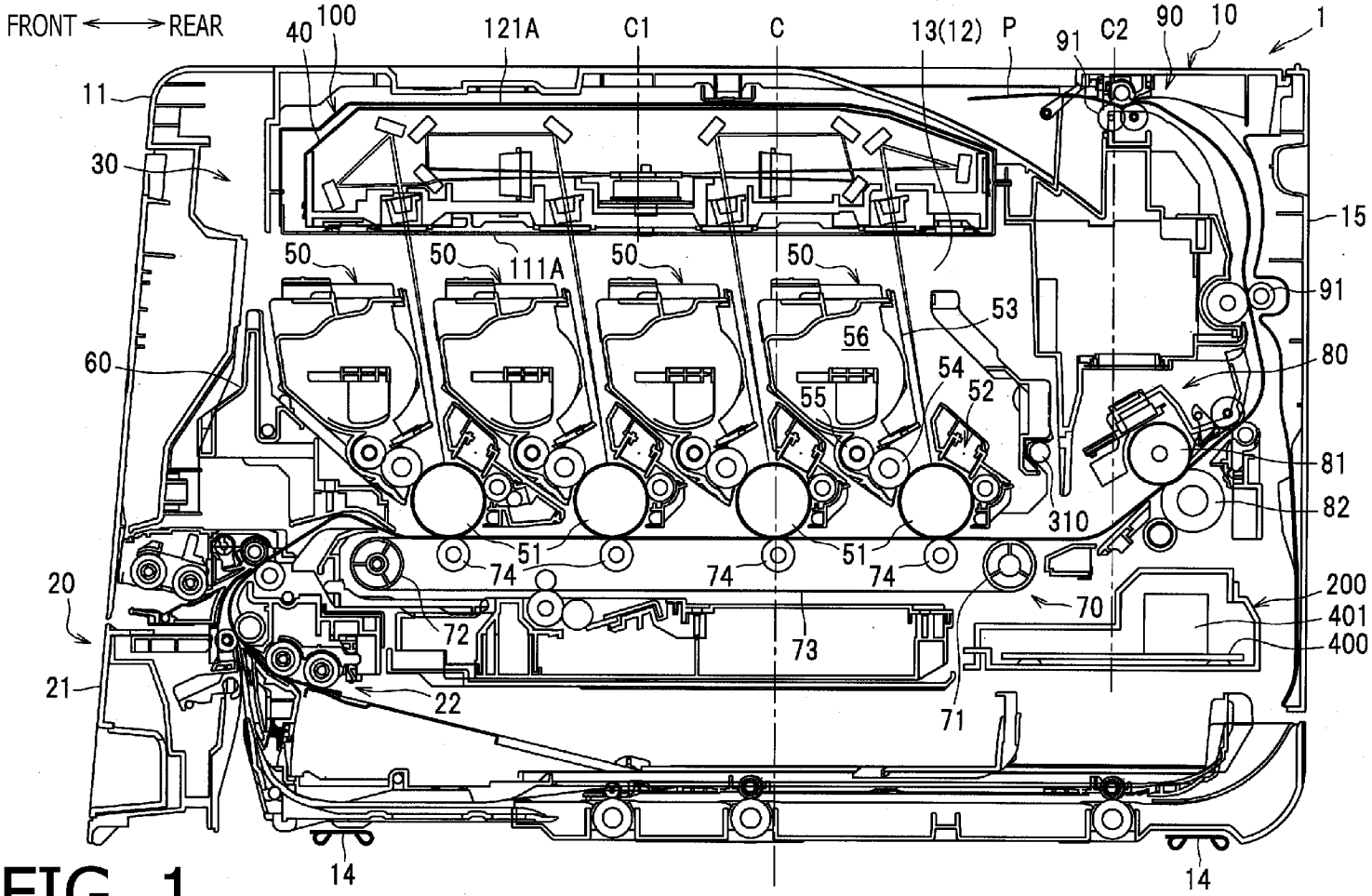
FIG. 1 is a cross-sectional side view of a color printer according to an embodiment of the present invention.

In the following description, directions concerning the color printer 1 will be referred to in accordance with orientation indicated by arrows in each drawing. Therefore, for example, a viewer's left-hand side appearing in FIG. 1 is referred to as a front side of the color printer 1, and a right-hand side in FIG. 1 opposite from the front side is referred to as a rear side. A side which corresponds to the viewer's nearer side is referred to as a right-hand for a user, and an opposite side from the right, which corresponds to the viewer's farther side is referred to as a left-hand side for the user. An up-down direction in FIG. 1 corresponds to a vertical direction of the color printer 1. Further, the right-to-left or left-to-right direction of the color printer 1 may be referred to as a widthwise direction, and the front-to-rear or rear-to-front direction may be referred to as a direction of depth. The widthwise direction and the direction of depth are orthogonal to each other. Furthermore, directions of the drawings in FIGS. 2-7 are similarly based on the orientation of the color printer 1 as defined above and correspond to those with respect to the color printer 1 shown in FIG. 1 even when the drawings are viewed from different angles.

Overall Configuration of the Color Printer

The color printer 1 includes a feeder unit 20, an image forming unit 30, and an ejection unit 90, which are arranged inside a body 10. The feeder unit 20 is configured to feed a sheet P in the body 10, the image forming unit 30 is configured to form an image on the sheet P being fed, and the ejection unit 90 is configured to eject the sheet P with the image formed thereon outside. A configuration of the body 10 of the color printer 1 will be described later in detail.

The feeder unit 20 includes a feeder tray 21 to store the sheet P therein and a sheet conveyer 22 to convey the sheet P from the feeder tray 21 to the image forming unit 30.

The image forming unit 30 includes an optical scanner 40, a plurality of (e.g., four) processing units 50, a drawer 60, a transfer unit 70, and a fixing unit 80.

The optical scanner 40 is arranged on one side of the plurality of processing units 50 along a direction orthogonal to an axial direction and to an aligning direction of photosensitive drums 51, which will be described later in detail. In other words, the optical scanner 40 is arranged in an upper position with respect to the plurality of processing units 50, in the body 10. The optical scanner 40 includes a laser-beam emitter (not shown), a plurality of polygon minors (unsigned), lenses (unsigned), and a plurality of reflection minors (unsigned). Laser beams emitted from the laser-beam emitter for a plurality of (e.g., four) colors are reflected on the polygon minors and the reflection minors and transmit through the lenses to be casted to scan on surfaces of photosensitive drums 51 in the processing units 50.

The processing units 50 are aligned in line, along a direction of depth (i.e., a front-rear direction) of the color printer 1, orthogonally to the direction of rotation axes of the photosensitive drums 51. Each of the processing units 50 includes the photosensitive drum 51, which is rotatable about a rotation axis thereof extending along the widthwise direction, a charger 52 to electrically charge the photosensitive drum 51, and a developer cartridge 53. Each developer cartridge 53 includes a developer roller 54 to supply a developer agent (e.g., toner) to the photosensitive drum 51 and a toner container 56 to store the toner therein. All the processing units 51 are configured similarly but different from one another in colors of the toner contained in the toner containers 56.

Figure 2:
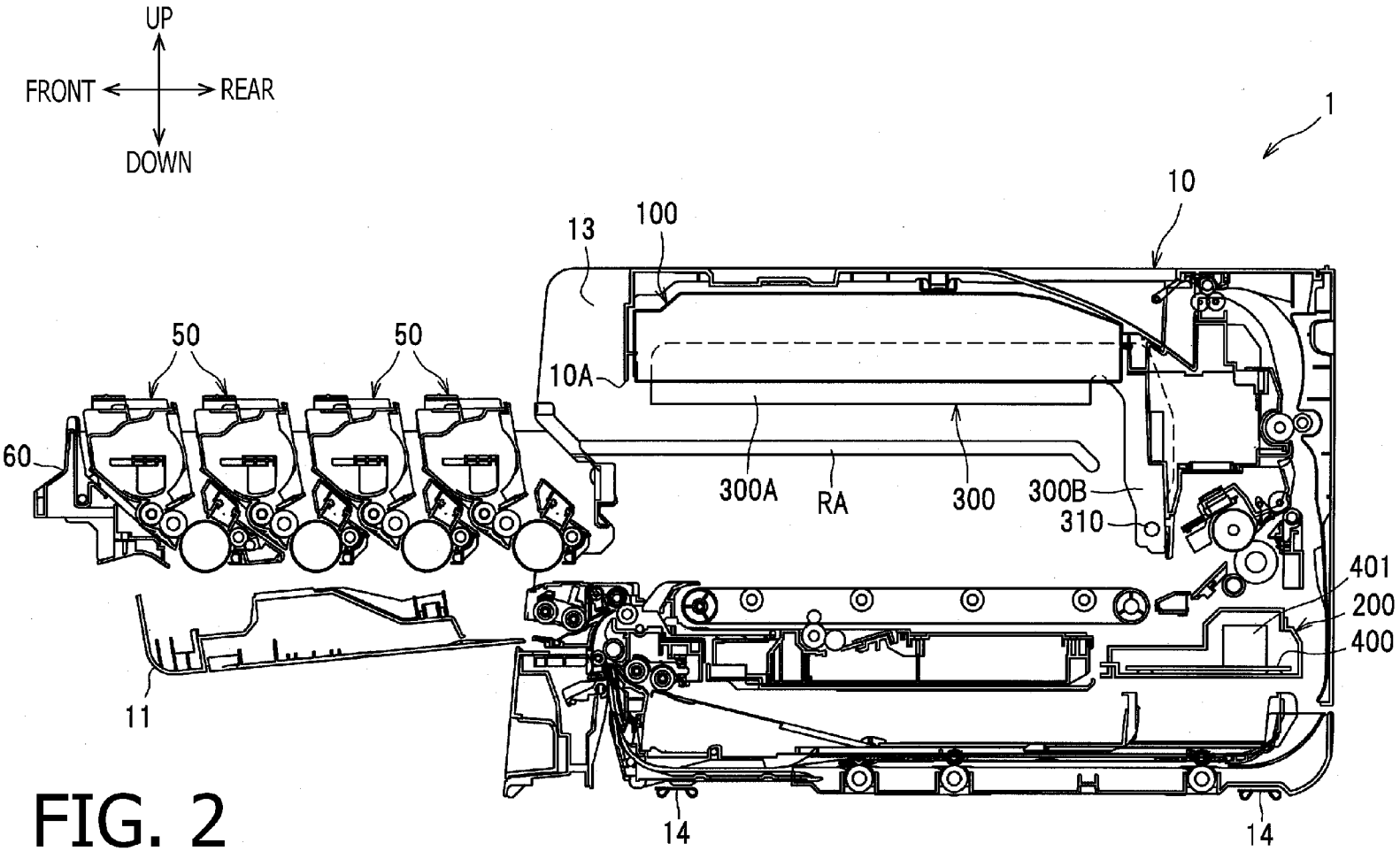
FIG. 2 is a cross-sectional side view of the color printer with a drawer being drawn out of a body of the color printer according to the embodiment of the present invention.
Figure 3:
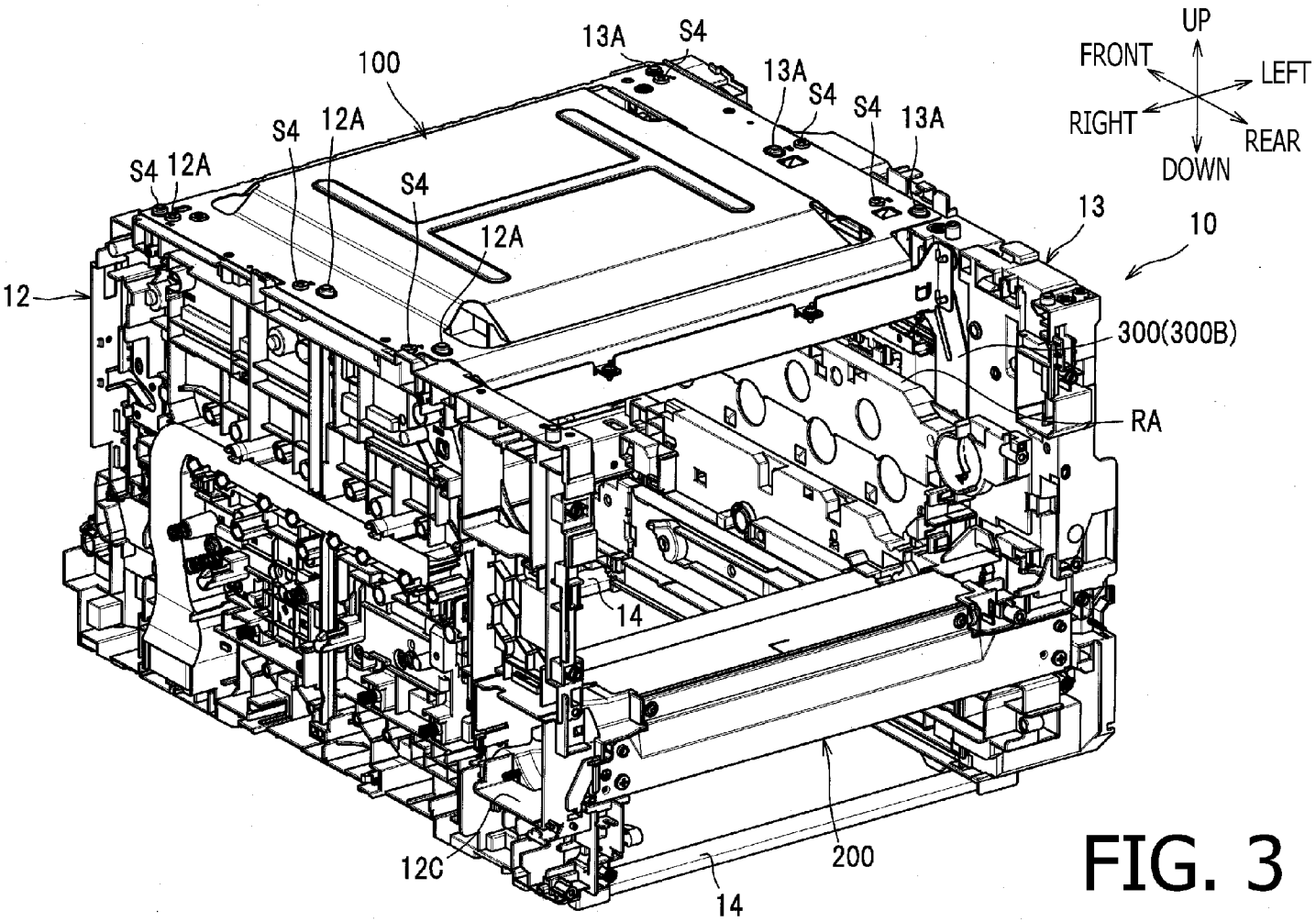
FIG. 3 is a perspective view of the body of the color printer according to the embodiment of the present invention.

The drawer 60 supports the plurality of processing units 50 and is movable along the front-rear direction with respect to a pair of side frames 12, 13, which form lateral walls of the body 10 of the color printer 1. Each of the side frames 12, 13 is provided with a rail RA, solely one of which on the left is shown in FIGS. 2 and 3, so that the drawer 60 is guided by the rails RA to move frontward or rearward along the front-rear direction. As shown in FIG. 2, the drawer 60 can be drawn out of the body 10 of the color printer 10 through an opening 10A, which is exposed when a front cover 11 arranged on the front side of the body 10 is opened. Thus, the processing units 50 are exposed to the outside atmosphere.

Referring back to FIG. 1, the transfer unit 70 is arranged in a position between the feeder unit 20 and the drawer 60. The transfer unit 70 includes a driving roller 71, a driven roller 72, a conveyer belt 73, and transfer rollers 74.

The driving roller 71 and the driven roller 72 are arranged to extend axially in parallel with each other in spaced-apart positions from each other along the front-rear direction so that the conveyer belt 73 being an endless belt is strained to roll around the driving roller 71 and the driven roller 72. The conveyer belt 73 is arranged to have an upper outer surface thereof to be in contact with the photosensitive drums 51. A plurality of (e.g., four) transfer rollers 74 are arranged in positions opposite from the photosensitive drums 51 across the conveyer belt 73, and the conveyer belt 73 is in contact with the transfer rollers 74 at an upper inner surface thereof. Transfer bias under constant current control is applied to the transfer rollers 74 to transfer an image from the photosensitive drums 51 to the sheet P.

The fixing unit 80 is arranged in a rear position with respect to the processing units 50 and includes a heat roller 81 and a pressure roller 82. The pressure roller 82 is arranged in a position to face the heat roller 81 and is urged against the heat roller 81.

In each of the processing units 50 in the image forming unit 30 configured as above, the charger 52 electrically charges a surface of the photosensitive drum 51 evenly, and the surface of the photosensitive drum 51 is exposed to the laser beam emitted selectively based on image data from the optical scanner 40 in order to form a lower-potential regions, i.e., an electrostatic latent image representing the image to be formed on the sheet P, thereon. Thereafter, the toner is supplied to the latent image on the photosensitive drum 51 from the developer cartridge 53 through the developer roller 54. Thus, the latent image is developed to be a toner image and carried on the surface of the photosensitive drum 51.

When the sheet P supplied from the feeder unit 20 is carried on the conveyer belt 73 to a position between the photosensitive drum 51 and the transfer roller 74, the toner image formed on the surface of the photosensitive drum 51 is transferred onto the sheet P. Thus, four colored images are sequentially overlaid on the surface of the sheet P to form a colored image. The sheet P with the transferred toner images is carried to a nipped position between the heat roller 81 and the pressure roller 82 in the fixing unit 80 to have the toner images thermally fixed thereon.

The ejection unit 90 includes a plurality of conveyer rollers 91 to convey the sheet P. The sheet P with the fixed image is ejected out of the body 10 of the color printer 1 by the conveyer rollers 91.

Configuration of the Body 10 of the Color Printer 1

As shown in FIG. 3, the body 10 of the color printer 1 includes the paired side frames 12, 13, a first connecting frame 100 to connect upper portions of the side frames 12, 13, a second connecting frame 200 to connect lower rear portions of the side frames 12, 13, and lower beams 14 to connect lower ends of the side frames 12, 13. The lower beams 14 are elongated metal bars extending along the widthwise direction. One of the lower beams 14 is arranged on the front side of the side frames 12, 13, and another one of the lower beams 14 is arranged on the rear side of the side frames 12, 13.

The side frames 12, 13 are resin plates, each of which is formed to have an approximate shape of a rectangle, and are arranged on the left side and the right side in the color printer 1 to have a predetermined amount of clearance there-between to accommodate the processing units 50 therein. The processing units 50 disposed in the clearance is supported by the side frames 12, 13 via the drawer 60.

The first connecting frame 100 is a metal frame forming a shape of a sleeve, which is hollow and provides a space inside, and a cross-section of the first connecting frame 100 taken along a plane orthogonal to the widthwise direction is closed. Widthwise ends of the first connecting frame 100 are connected to the side frames 12, 13. The first connecting frame 100 is arranged in an upper position with respect to the processing units 50 and accommodates the optical scanner 40 in the hollow space.

With the sleeve-shaped first connecting frame 100 connected with the side frames 12, 13 at the widthwise ends thereof, the first connecting frame 100 can provide enhanced rigidity compared to, for example, the conventional frame structure, in which the upper and lower plates independently arranged in the upper and lower positions with respect to the optical scanner are connected to the side frames respectively. In this regard, while the optical scanner 40 is accommodated in the first connecting frame 100, the first connecting frame 100 may not only provide the increased rigidity to the color printer 1 but also protect the optical scanner 40 securely.

The first connecting frame 100 is formed to have a dimension in the front-rear direction being substantially equivalent to a dimension in the front-rear direction of the drawer 60 and is arranged to overlap the processing units 50 in a perspective view projected along the vertical direction. Thus, the first connecting frame 100 arranged over the processing units 50 may provide the rigidity to the body 10 of the color printer 1 effectively.

Meanwhile, the first connecting frame 100 is arranged to locate a center C1 thereof along the front-rear direction in a frontward position deviated from a center C of the side frames 12, 13 along the front-rear direction. In other words, the first connecting frame 100 is arranged in a frontward off-centered position closer to the front ends rather than the rear ends of the side frames 12, 13.

Figure 4:
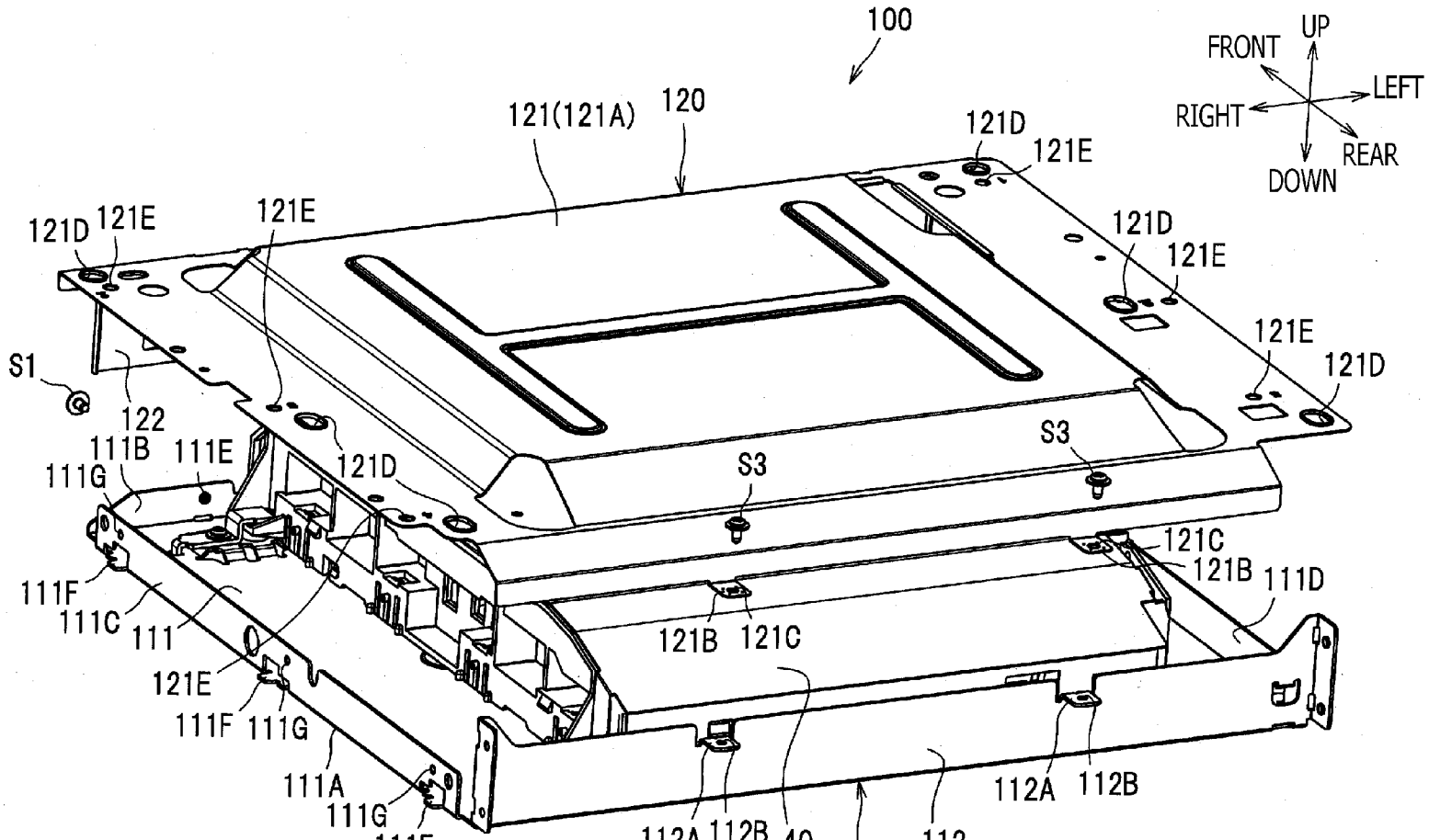
FIG. 4 is an exploded view of a first connecting frame in the color printer according to the embodiment of the present invention viewed from an upper rear view point.

As shown in FIG. 4, the first connecting frame 100 includes a first metal plate 110 and a second metal plate 120, which are formed to have cross-sectional shapes of "L." The first metal plate 110 includes a lower plate 111 to be arranged in a lower position with respect to the optical scanner 40 to support the optical scanner 40 and a rear plate 112 to be arranged in a rear position with respect to the optical scanner 40.

The lower plate 111 is formed in an approximate shape of a rectangle and has a lower plane 111A, which spreads along the front-rear direction and the widthwise direction. The lower plane 111A faces the processing units 50 (see FIG. 1). The lower plate 111 includes flanges 111B, 111C, 111D, which extend upward from a front end, a right-side end, and a left-side end of the lower plate 111 respectively.

The flange 111B, at the front end of the lower plate 111, is formed to have a plurality of in-flange holes 111E, in which screws S1 to fasten the second metal plate 120 to the first metal plate 110 are screwed. In other words, the flange 111B provides a fixing structure, by which the second metal plate 120 is fixed to the first metal plate 110, in the areas surrounding the in-flange holes 111E.

Figure 5:
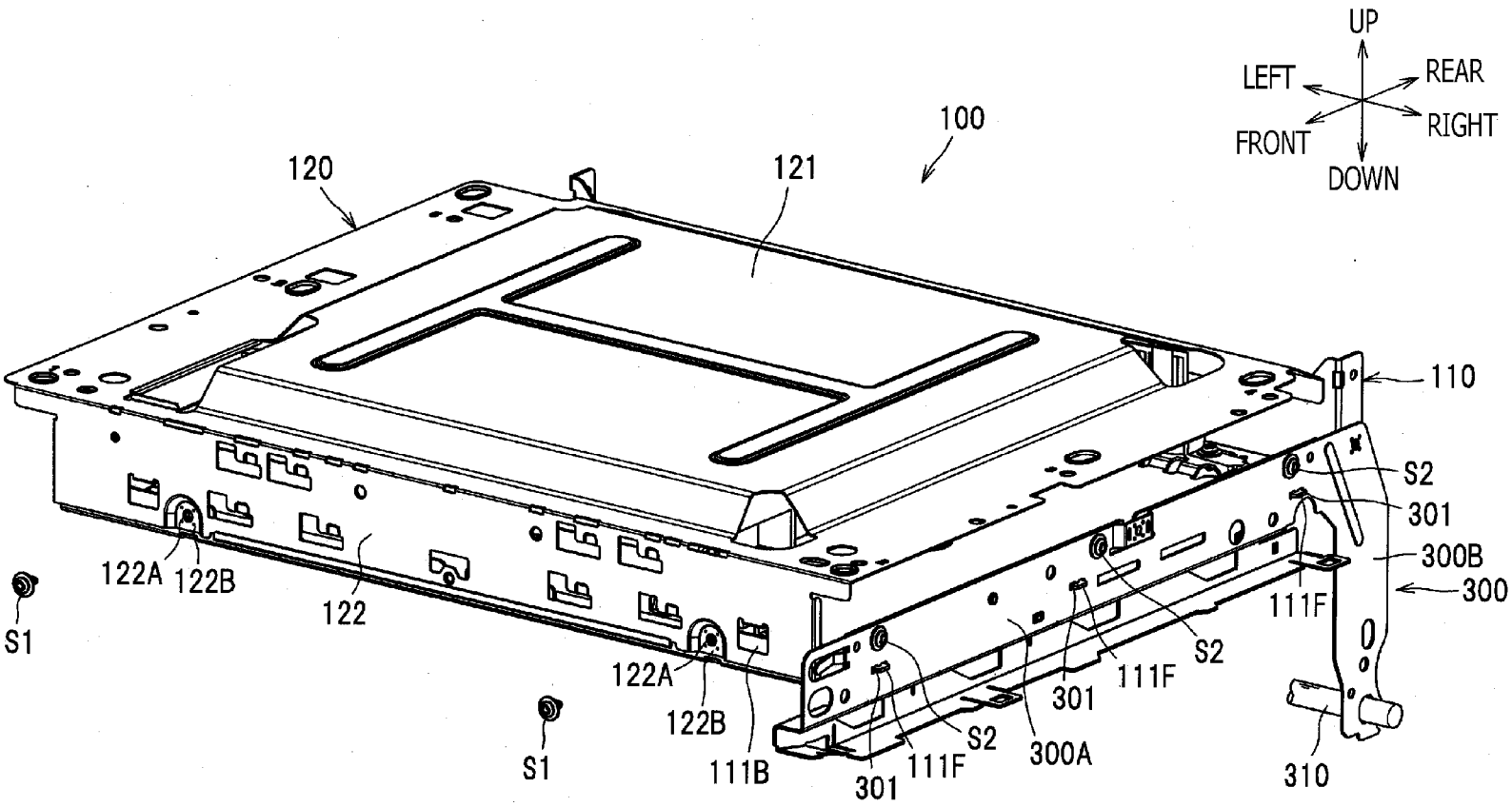
FIG. 5 is an exploded view of a second connecting frame and an L-shaped metal piece in the color printer according to the embodiment of the present invention taken from an upper front view point.

On the right-side end of the lower plate 111, a plurality of engageable protrusions 111F, which protrude outward along the widthwise direction from the flange 111C on the right-hand side, are formed. The engageable protrusions 111F are formed when the flange 111C is bent upward. More specifically, the engageable protrusions 111F originally consist of parts of the flange 111C until the flange 111C is bent with respect to the lower plate 111. Once openings, of which shape correspond to the engageable protrusions 111F, are formed in the flange 111C, and the flange 111C is bent with respect to the lower plate 111, the engageable protrusions 111F remain unbent to protrude outward from the right-side end of the lower plate 111 along the widthwise direction. The engageable protrusions 111F formed as above are, as shown in FIG. 5, inserted in engageable openings 301 from inside toward outside along the widthwise direction. The engageable openings 301 are formed in an L-shaped metal piece 300, which is fixed to the side frame 12.

The L-shaped metal piece 300 includes a main part 300A elongated along the front-rear direction and an extended part 300B extended downward from the main part 300A toward a side where the photosensitive drums 51 are disposed. The main part 300A is arranged to overlap the first connecting frame 100 in a perspective view projected along the widthwise direction, which coincides with the axial direction of the photosensitive drums 51. The extended part 300B supports a positioning shaft 310 (see also FIG. 1), which is engageable with a rear part of the drawer 60 to place the drawer 60 in a correct position in the body 10 of the color printer 1. The L-shaped metal piece 300 is stably fixed to the side frame 12 on an inner side of the side frame 12 along the widthwise direction.

As shown in FIGS. 4 and 5, the flange 111C on the right is formed to have a plurality of in-flange holes 111G, in which screws S2 to fasten the flange 111C to the L-shaped metal piece 300 are screwed, in upper positions in the flange 111C. Thus, with the L-shaped metal piece 300 fastened to the first metal plate 110, rigidity of the L-shaped metal piece 300 can be increased. Therefore, while the rigidity of the L-shaped metal piece 300 is secured, the drawer 60 can be placed in the correct position preferably by relying on the position of the L-shaped metal piece 300. Further, a relative position between the optical scanner and the drawer 60 can be maintained correctly.

Although detailed description is herein omitted, the left-side end of the lower plate 111 is configured to have the same structure, including the engageable protrusions 111F, the in-flange holes 111G, and the L-shaped metal piece 300, as the right-side end of the lower plate 111.

As shown in FIG. 4, the rear plate 112 is formed by bending a rear portion of the lower plate 111 upward. The rear plate 112 includes a plurality of fixing flanges 112A, which are formed by cuts and bends to protrude rearward, at an upper end thereof. Each of the fixing flanges 112A is formed to have an in-flange hole 112B, in which a screw S3 to fasten the second metal plate 120 to first metal plate 110 is screwed.

The second metal plate 120 includes an upper plate 121 and a front plate 122, which are to be arranged in an upper position and a frontward position with respect to the optical scanner 40 respectively.

The upper plate 121 is arranged to spread along an upper surface of the optical scanner 40. The upper plate 121 is formed to have an upward bulge in a central portion thereof, to have a cross-sectional shape similar to a cross-section of a hat. The upper plate 121 includes an upper plane 121A, which spreads in parallel with the lower plane 111A of the lower plate 111. The upper plane 121A faces the lower plane 111A of the lower plate 111 across the optical scanner 40 (see FIG. 1). The upper plate 121 includes a plurality of fixing flanges 121B on a rear edge thereof. The plurality of fixing flanges 121B protrude rearward from the rear edge of the upper plate 121 and are formed to have through holes 121C, in which the screws S3 to fasten the second metal plate 120 to first metal plate 110 are screwed.

Thus, by placing the fixing flanges 112A of the first metal plate 110 over the fixing flanges 121B of the second metal plate 120, and by fastening the screws S3 through the through holes 121C to the in-flange holes 112B, the rear plate 112 in the first metal plate 110 and the rear end of the upper plate 121 in the second metal plate 120 are fastened to each other.

On widthwise ends of the upper plate 121, a plurality of positioning holes 121D are formed. The positioning holes 121D are engageable with a plurality of positioning projections 12A, 13C, which are formed to protrude upward from upper edges of the side frames 12, 13 respectively (see FIG. 3). Further, the upper plate 121 is formed to have a plurality of through holes 121E, through which a plurality of screws S4 (see FIG. 3) to fasten the upper plate 121 to the side frames 12, 13 are screwed, in positions in proximity to the positioning holes 121D. Meanwhile, on the upper edges of the side frames 12, 13, a plurality of screw holes (not shown), to which the screws S4 are screwed, are formed.

Thus, as shown in FIGS. 3 and 4, when the first metal plate 110 is placed on the upper edges of the side frames 12, 13 with the positioning holes 121D fitted around the positioning projections 12A, 13A, the through holes 121E coincide with the screw holes formed in the side frames 12, 13. Therefore, when the screws S4 are screwed to the screw holes in the side frames 12, 13 through the through holes 121E, the upper plate 121 is fastened to the side frames 12, 13.

As shown in FIG. 5, the front plate 122 is formed by bending a front portion of the upper plate 121 downward. When the first metal plate 110 and the second metal plate 120 are assembled together, the front plate 122 covers the flange 111B at the front side of the first metal plate 110 from outside along the front-rear direction. The front plate 122 is formed to have a plurality of through holes 122A, through which the screws Si are inserted, in lower positions corresponding to the in-flange holes 111E (see FIG. 4) formed in the flange 111B of the first metal plate 110. More specifically, each of the through holes 122A is formed on a closed-end wall in a dent 122B, which is formed to recess rearward from the front plate 122, while a rear side of the closed-end wall in the dent 122B contacts the flange 111B on the front side of the first metal plate 110.

Therefore, by placing the front plate 122 on the outer side of the flange 111B of the first metal plate 110 to cover the flange 111B along the front-rear direction, and by fastening the screws S1 through the through holes 122A to the in-flange holes 111E, the flange 111B on the front side of the first metal plate 110 and the front plate 122 are fastened to each other. Thus, the first connecting frame 100 having the first metal plate 110 and the second metal plate 120 is formed to have a shape of a sleeve with a closed cross-section when taken along the plane orthogonal to the widthwise direction. In this regard, the first metal plate 110 and the second metal plate 120 are coupled to the side frames 12, 13 at the widthwise ends thereof.

As shown in FIG. 1, the second connecting frame 200 is a metal frame formed in a shape of a sleeve, which is hollow and provides a space inside. A cross-section of the second connecting frame 200 is closed when taken along the plane orthogonal to the widthwise direction. The second connecting frame 200 is coupled to the side frames 12, 13 at widthwise ends thereof. The second connecting frame 200 is arranged in a lower position with respect to the processing units 50.

Thus, the first connecting frame 100 and the second connecting frame 200 are arranged to align along the vertical direction to place the processing units 50 interposed therebetween. Therefore, central areas of the side frames 12, 13, i.e., areas coincident with the processing units 50 along the direction of rotation axes, can be effectively enhanced.

According to the configuration described above, the drawer 60 to support the processing units 50 is arranged in the intermediate position between the first connecting frame 100 and the second connecting frame 200 along the vertical direction; therefore, the rigidity of the body 10 of the color printer 1 can be maintained while the space for the drawer 60 to move therein is reserved.

According to the configuration described above, a central area C2 of the second connecting frame 200 along the front-rear direction is arranged in a rearward position deviated from the center C of the side frames 12, 13 along the front-rear direction. In other words, the second connecting frame 200 is arranged in the rearward off-centered position closer to the rear ends rather than the front ends of the side frames 12, 13. Therefore, with regard to the relative position among the second connecting frame 200, the side frames 12, 13, and the first connecting frame 100, the first connecting frame 100 is disposed in the frontward position closer to the front ends of the side frames 12, 13 while the second connecting frame 200 is disposed in the rearward position closer to the rear ends of the side frames 12, 13. Thus, the first connecting frame 100 and the second connecting frame 200 are disposed in diagonal positions with respect to each other in the side frames 12, 13. Accordingly, the rigidity of the body 10 of the color printer 1 may be effectively increased.

According to the configuration described above, the second connecting frame 200 is formed to range from a position in proximity to the rear end of the first connecting frame 100 to a position in proximity to the rear ends of the side frames 12, 13 along the front-rear direction. Further, the second connecting frame 200 is arranged to overlap the first connecting frame 100, at least partly, in the perspective view projected along the vertical direction. Therefore, an entire range of the side frames 12, 13 along the front-rear direction is enhanced by the first and second connecting frames 100, 200, and the rigidity of the body 10 of the color printer 1 may be effectively increased.

Meanwhile, inside the second connecting frame 200, a power board 400 to supply power to electrically movable components, such as the processing units 50, is disposed. On the power board 400, a transformer 401 (see FIGS. 1, 2, and 7) being one of elements composing a power circuit, is mounted. While the power board 400 is accommodated in the metal-made second connecting frame 200, noises generated in the power board 400 may be prevented from being radiated.

Figure 6:
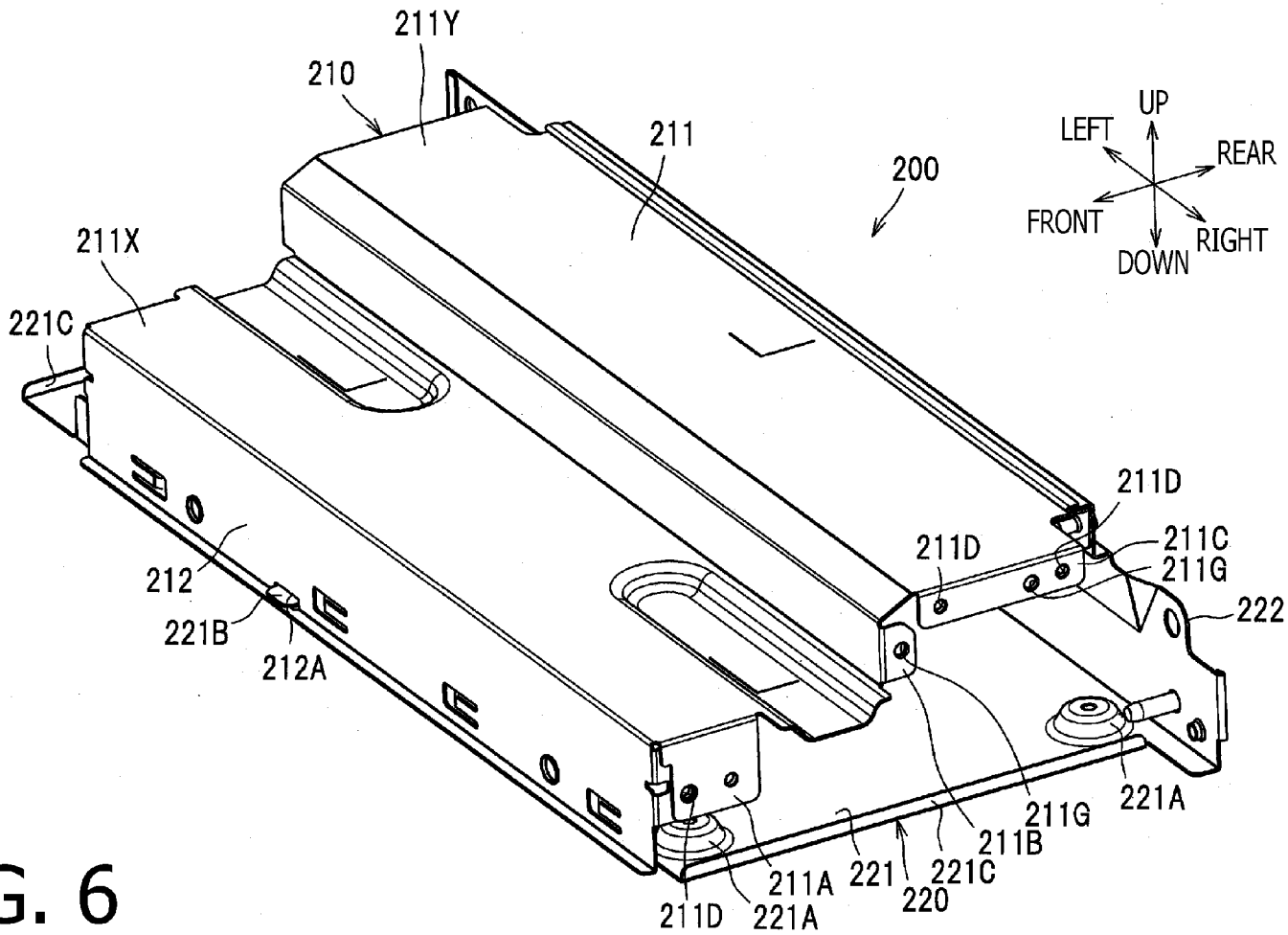
FIG. 6 is an exploded view of the second connecting frame in the color printer according to the embodiment of the present invention viewed from an upper front view point.
Figure 7:
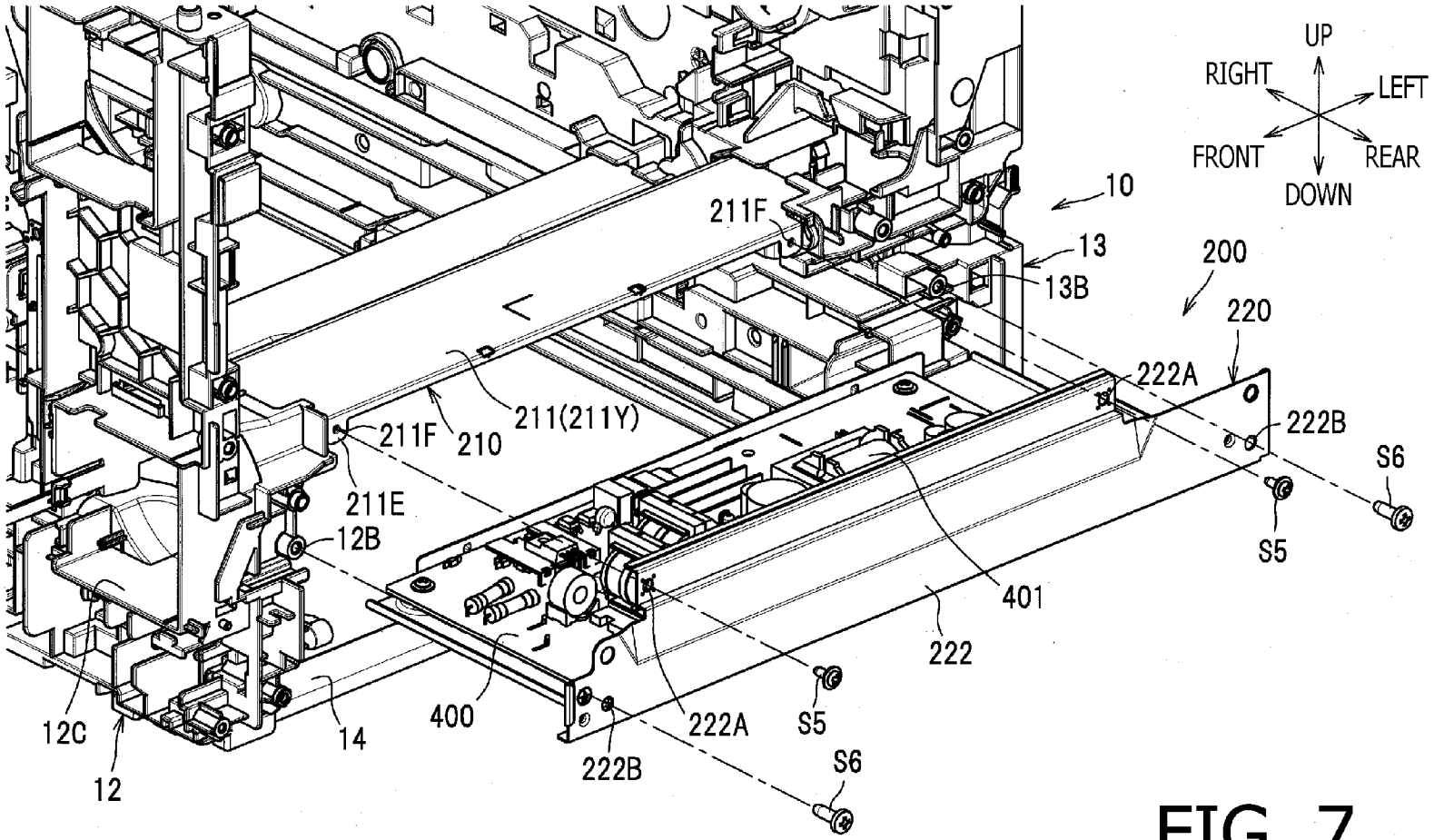
FIG. 7 is a perspective view of a third plate in the body of the color printer and a fourth plate being removed from side frames in the color printer according to the embodiment of the present invention.

As shown in FIGS. 6 and 7, the second connecting frame 200 includes a third metal plate 210 and a fourth metal plate 220, which are formed to have approximately L-shaped cross-sections when taken along the plane orthogonal to the widthwise direction.

The third metal plate 210 includes an upper wall 211 and a front wall 212, which are arranged in an upper position and a frontward position with respect to the power board 400 respectively. The upper wall 211 is formed to have a front part 211X and a rear part 211Y, which are formed in split levels. The rear part 211Y is formed in an upper level, and the front part 211X is formed in a lower level. The transformer 401 is disposed in a lower position with respect to the rear part 211Y. On widthwise ends of the upper wall 211, fixing flanges 211A, 211B, 211C are formed by bending end portions downward or rearward in the sleeve-shaped second connecting frame 200. The fixing flanges 211A-211C are formed to have through holes 211D, through which screws (not shown) to fasten the fixing flanges 211A-211C to the side frames 12, 13 are inserted. Further, the fixing flanges 211B, 211C are formed to have reference openings 211G, which are referred to when the second connecting frame 200 is placed in the correct position with respect to the side frames 12, 13.

A plurality of connecting flanges 211E are formed by bending rear-end portions of the upper wall 211 downward. Each of the connecting flanges 211E is formed to have an in-flange hole 211F, through which a screw S5 to fasten the fourth metal plate 220 to the third metal plate 210 is inserted.

The front wall 212 of the third metal plate 210 is formed by bending a front end portion of the upper wall 211 downward. At a lower end of the front wall 212, an engageable hole 212A, through which an engageable piece 221B of the fourth metal plate 220 is inserted from the rear side toward the front side, is formed. The engageable piece 221B will be described later in detail.

The fourth metal plate 220 includes a lower wall 221, which is arranged in a lower position with respect to the power board 400 to support the power board 400, and a rear wall 222 arranged in a rearward position with respect to the power board 400.

The lower wall 221 is formed in an approximate shape of a rectangle and has a plurality of bulges 221A, which protrude upward to support the power board 400. At a front end of the lower wall 221, the engageable piece 221B is formed to protrude frontward.

On widthwise ends of the lower wall 221, engageable flanges 221C protruding upward are formed by bending widthwise end portions of the lower wall 221 upward. The engageable flanges 221C are movably supported by grooves formed in the side frames 12, 13 to move along the front-rear direction.

The rear wall 222 is formed by bending a rear end portion of the lower wall 221 upward. At upper positions in the rear wall 222, as shown in FIG. 7, a plurality of through holes 222A, through which the screws S5 to fasten the fourth metal plate 220 to the third metal plate 210 is inserted, is formed. At lower positions in the rear wall 222, a plurality of through holes 222B, through which screws S6 to fasten the fourth metal plate 220 to the side frames 12, 13 are inserted, are formed. Meanwhile, the side frames 12, 13 are formed to have screw holes 12B, 13B, to which the screws S6 are screwed, respectively.

The fourth metal plate 220 is movable along the front-rear direction to be detached from or attached to the third metal plate 210 and the side frames 12, 13 while the screws S5, S6 are removed. Therefore, by removing the fourth metal plate 220 from the third metal plate 210 and the side frames 12, 13, a user can easily access the power board 400 to exchange with a new power board 400. More specifically, through an opening which is exposed when a rear cover 15 (see FIG. 1) arranged on the rear side of the body 10 of the color printer 1 is opened, the fourth metal plate 220 can be removable from the third metal plate 210 and the side frames 12, 13.

Thus, the second connecting frame 200, including the third metal plate 210 and the fourth metal plate 220, is formed in a shape of a sleeve having a closed cross-section, when taken along the plane orthogonal to the widthwise direction. Meanwhile, the third metal plate 210 and the fourth metal plate 220 are coupled to the side frames 12, 13 at the widthwise ends thereof. In this regard, the second connecting frame 200 is open sideward at the widthwise ends thereof, and one of the openings on the right aligns with an air duct 12C formed in the side frame 12 so that air to cool the power board 400 can be introduced through the air duct 12C and the opening.

According to the embodiment described above, with the first connecting frame 100 having the lower plane 111A and the upper plane 121A, which spread in parallel with each other along the front-rear direction, when external force is applied to the side frames 12, 13, the relative position between the optical scanner 40 and the processing units 50 can be maintained substantially in parallel steadily.

According to the embodiment described above, the first connecting frame 100 is formed with the metal plates 110, 120, which provide certain rigidity. Therefore, the first connecting frame 100 can maintain the stable shape of the sleeve, and the optical scanner 40 can be securely stored inside the connecting frame 100.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the developer cartridge 53 may not necessarily be configured to include the developer roller 54 and the toner container 56 but may include a developer device containing the rollers alone, and the toner container 56 may be replaced with an exchangeable toner cartridge.

For another example, the sleeve-form of the connecting frames 100, 200 may not necessarily include the L-shaped metal pieces. For example, the sleeve-form of the connecting frames 100, 200 may be achieved by assembling a U-shaped metal piece and a flat metal plate. For another example, the sleeve-form may be achieved by forming the upper, lower, front, and rear sides of each of the connecting frames 100, 200 integrally.

For another example, the electrically movable components may not necessarily be limited to the processing units 50 but may include, for example, a motor to drive the photosensitive drums 51.

For another example, the processing units 50 supported by the drawer 60 may be removable from the drawer 60. For another example, a part of each processing unit 50, such as the developer cartridge 53, may be removable from the drawer 60. For another example, the photosensitive drums 51 may be integral with the drawer 60 to be supported by the drawer 60.

The embodiment described above may not necessarily be applied to a monochrome printer, a color printer but may be employed in, for example, a copier or a multifunction peripheral device.

What is claimed is:

1. An image forming apparatus, comprising:

a plurality of image forming units, each of which comprises a respective photosensitive drum configured to be rotatable about a rotation axis and a developer device configured to supply a developer agent to the respective photosensitive drum, the plurality of image forming unit being aligned along an aligning direction, the aligning direction being orthogonal to an axial direction of the rotation axes of the photosensitive drums;

a pair of frames arranged to face each other along the axial direction across the plurality of image forming units, the pair of frames being configured to support the plurality of image forming units;

an optical scanner arranged on one side of the plurality of image forming units in an orthogonal direction orthogonal to the aligning direction and to the axial direction, the optical scanner being configured to emit exposure light to the plurality of photosensitive drums;

a first connecting frame made of metal and formed to be hollow providing a first space therein, the first connecting frame being coupled to the pair of frames at both ends thereof along the axial direction and being configured to accommodate the optical scanner in the first space, the first connecting frame being disposed above the plurality of image forming units in the orthogonal direction; and a second connecting frame made of metal and arranged below the plurality of image forming units in the orthogonal direction, the second connecting frame being formed to be hollow providing a second space therein, the first space being formed separately from the second space, the second connecting frame extending in the axial direction between and coupling the pair of frames at both ends thereof along the axial direction, the second connecting comprising an upper portion extending between and connecting the pair of frames, wherein the second connecting frame and the pair of frames are configured to enclose a power board within the second space such that a top surface of the power board is disposed lower, in the orthogonal direction, than a bottom surface of the upper portion of the second connecting frame, the power board being configured to supply power to electrically movable components of the image forming apparatus.

2. The image forming apparatus according to claim 1, wherein the first connecting frame is arranged to overlap the plurality of image forming units when viewed in the orthogonal direction.

3. The image forming apparatus according to claim 1, wherein the first connecting frame is arranged with a center thereof located in a first deviated position with respect to a center of the pair of frames, the first deviated position being closer to one end than another end of the pair of frames along the aligning direction, and wherein the second connecting frame is arranged with a center thereof located in a second deviated position with respect to the center of the pair of frames, the second deviated position being closer to the another end than the one end of the pair of frames along the aligning direction.

4. The image forming apparatus according to claim 3, wherein the first connecting frame is arranged to partly overlap the second connecting frame when viewed in the orthogonal direction.

5. The image forming apparatus according to claim 1, wherein the first connecting frame comprises:

a first plane facing the plurality of image forming units and spreading in parallel with the aligning direction; and a second plane facing the first plane across the optical scanner and spreading in parallel with the first plane.

6. The image forming apparatus according to claim 5, wherein the first connecting frame comprises a first metal plate comprising the first plane, a second metal plate comprising the second plane, and a fixing part, by which the first metal plate and the second metal plate are fixed to each other.

7. The image forming apparatus according to claim 1, further comprising:

a drawer configured to support the plurality of image forming units, the drawer being supported by the pair of frames movably to move along the aligning direction, wherein the drawer is arranged in an intermediate position between the first connecting frame and the second connecting frame along the orthogonal direction.

8. An image forming apparatus, comprising:

a first frame;

a second frame arranged to face the first frame;

a first connecting frame connecting the first frame and the second frame, wherein:

the first connecting frame comprises a first plate and a second plate, and the first connecting frame has a first hollow space that is formed between the first plate and the second plate;

an image forming unit disposed between the first frame and the second frame, the image forming unit comprising a photosensitive drum configured to be rotatable about a rotation axis and a developer device configured to supply a developer agent to the photosensitive drum;

a second connecting frame connecting the first frame and the second frame, wherein:

the second connecting frame comprises a third plate and a fourth plate both extending in an axial direction of the rotation axis, and the second connecting frame has a second hollow space between the third plate and the fourth plate;

an optical scanner configured to emit light to the photosensitive drum, the optical scanner is disposed inside of the first hollow space formed between the first plate and the second plate; and a power board configured to supply power, the power board being disposed inside of the second hollow space enclosed by the first frame, the second frame, the third plate and the fourth plate such that a top surface of the power board is disposed lower, in a vertical direction perpendicular to the axial direction, than a bottom surface of the third plate, wherein the first frame and the second frame are made of resin, and wherein the first plate and the second plate of the first connecting frame and the third plate and the fourth plate of the second connecting frame are metal plates.

9. The image forming apparatus according to claim 1, wherein the pair of frames are made of resin, and the first connecting frame and the second connecting frame are metal plates.

10. The image forming apparatus according to claim 8, further comprising:

a drawer configured to support the image forming unit, the drawer being supported by the first frame and the second frame, the drawer being disposed between the first connecting frame and the second connecting frame.

* * * * *